US005651795A

United States Patent [19]

Gurley

[11] Patent Number: 5,651,795

[45] Date of Patent: Jul. 29, 1997

[54] MORDANT COMPOSITION CONTAINING CITRIC ACID FOR DYE PROCESSES

[75] Inventor: Sally Gurley, Boulder, Colo.

[73] Assignee: Allegro Natural Dyes LLC, Longmont, Colo.

[21] Appl. No.: 715,789

[22] Filed: Sep. 19, 1996

Related U.S. Application Data

[63] Continuation of Ser. No. 476,507, Jun. 7, 1995, abandoned, which is a continuation-in-part of Ser. No. 414,341, Mar. 31, 1995, Pat. No. 5,509,941, which is a continuation-in-part of Ser. No. 59,544, May 10, 1993, Pat. No. 5,403,362.

[51] Int. Cl.[6] ..... D06P 1/673; D06P 1/653; D06P 5/22

[52] U.S. Cl. ..... 8/599; 8/600; 8/595; 8/596; 8/625; 8/646

[58] Field of Search ..... 8/524, 625, 646, 8/595, 596, 599, 600

[56] References Cited

U.S. PATENT DOCUMENTS

| | | | |
|---|---|---|---|
| 143,449 | 6/1873 | Hagemann | 8/525 |
| 192,201 | 6/1877 | Van Skelline . | |
| 671,760 | 4/1901 | Florin . | |
| 1,273,293 | 7/1918 | Warkup . | |
| 1,565,515 | 12/1925 | Seyer . | |
| 1,757,066 | 5/1930 | Watson . | |
| 2,090,396 | 8/1937 | Chapin et al. | 8/5 |
| 2,152,182 | 3/1939 | Ellis . | |
| 2,373,198 | 4/1945 | Roehrich | 252/317 |
| 2,502,911 | 4/1950 | Wolfram | 8/4 |
| 2,991,143 | 7/1961 | Rosenlind . | |
| 3,123,481 | 3/1964 | Seiber, Jr. | 8/94.29 |
| 3,525,628 | 8/1970 | Cohly | 426/105 |
| 3,922,356 | 11/1975 | Cohly | 426/105 |
| 3,930,036 | 12/1975 | Burke | 426/105 |
| 4,233,329 | 11/1980 | Burke | 426/277 |
| 4,283,198 | 8/1981 | Fletcher | 8/653 |
| 4,486,237 | 12/1984 | Paffoni et al. | 106/308 Q |
| 4,756,037 | 7/1988 | McFadyen et al. | 8/150 |
| 4,845,789 | 7/1989 | Morten et al. | 8/150 |
| 4,882,140 | 11/1989 | Becker | 423/629 |
| 5,221,289 | 6/1993 | Miyamatsu et al. | 8/646 |

FOREIGN PATENT DOCUMENTS

| | | |
|---|---|---|
| 261 637 | 3/1988 | European Pat. Off. . |
| 58-120882 | 7/1983 | Japan . |
| 63-309679 | 12/1988 | Japan . |
| WO94/26822 | 11/1994 | WIPO . |

OTHER PUBLICATIONS

Crews, P., Part 1. Considerations in the Selection and Application of Natural Dyes: Mordant Selection,: Shuttle, Spindle & Dyepot 12:15,62 (Spring, 1981).

J. Greene, "Plant Dyes for Homespun Color," Horticulture (Aug. 1978).

R. Smith and S. Wagner, "Dyes and the Environment: Is Natural Better?" Amer. Dyestuff Rep. 80(9):32 (Sep. 1991).

Mitsuo, K. et al. (1990), "Studies on the dyeing mechanism of natural dyes. III. Dyeing with natural pigments in foods an their fastness," Chem. Abstracts 113:(22), Abstract No. 193325.

Bahl, D. et al., "Development of Dyeing Process of Silk with Natural Dye–cutch," (1988) 35(22):22–24.

Bliss, A., *A Handbook of Dyes from Natural Materials,* Charles Scribner's Sons, New York, pp. 38–39 (1981).

Crews, P., Part 1. "Considerations in the Selection and Application of Natural Dyes: Mordant Selection," Shuttle, Spindle & Dyepot (1981) 12:15, 62.

Garg, A. et al., "Effect of Mordants on Color of Natural Dye Extracted from Tessue Flowers (*Butea mongsperma*)," Colourage (1991) 38(3):50–53.

Greene, J., "Plant Dyes for Homespun Color," Horticulture (Aug. 1978) pp. 32–35.

Padhye, R.N. and Rathi, D., "Effect on Mordant Dyeing of Cotton with Vegetable Dyes," Textile Dyer & Printer (1990) 23(25):27–28.

Rama, S.J. and Gupta, K.C., "Parijataka—a good source of dye for woolens," Textile Dyer & Printer (1990) 23(25):27–28.

Sauvé, P.M., "Natural Dyes in Quebec," Color. Res. & Appl. (1981) 6:172–173.

Sayeed, A. et al., "Jute Fiber Dyeing with Catechu Tannic Acid and Catechin," Indian Textile J. (1990) 100(9):114–119.

Shenai, V.A.A. et al., "Studies on Natural Dyes, Part 2 Dyeing and Printing of Cotton Cloth with Ain Bark Extract by Suitable After–Treatments," Textile Dyer & Printer (1979) 12:29–31.

Simmons, M., "The mordant process for the natural dyestuffs," *Dyes and Dyeing,* Van Nostrand Reinhold Co. (1978) pp. 42–47.

Vednere, S. et al., "Teak leaves and chir bark as natural dyes for wool," Colourage (1990) 37(20):48–49.

*Primary Examiner*—Margaret Einsmann

*Attorney, Agent, or Firm*—Greenlee, Winner and Sullivan, P.C.

[57] ABSTRACT

A mordant for dyeing fibers is provided comprising an aluminum salt, preferably $Al_2(SO_4)_3$, potassium or sodium carbonate, preferably the latter, and citric acid, capable of forming an aluminum hydroxide suspension in aqueous media having a pH of about 3.5–4. Methods of use of this composition are also provided. The mordant is useful in commercial dye processes including package dyeing.

20 Claims, No Drawings

MORDANT COMPOSITION CONTAINING CITRIC ACID FOR DYE PROCESSES

CROSS-REFRENCE TO RELATED APPLICATION

This application is a continuation of application Ser. No. 08/476,507 filed Jun. 7, 1995 now abandoned, which is a continuation-in-part of U.S. application Ser. No. 08/414,341 filed Mar. 31, 1995 U.S. Pat. No. 5,509,941, a continuation-in-part of U.S. application Ser. No. 08/059,544 filed May 10, 1993, now U.S. Pat. No. 5,403,362, both of which are incorporated herein by reference.

FIELD OF THE INVENTION

This invention lies in the field of mordant compositions useful for natural and synthetic dye processes.

BACKGROUND OF THE INVENTION

The use of synthetic dyes began with Perkin's accidental synthesis of mauvein ($C_{27}H_{24}N_4$) or "aniline purple" in 1856. Perkin was attempting to synthesize quinine, but recognized the commercial potential of mauvein as a synthetic dye. The synthetic dye industry was the major synthetic organic chemical industry in the early 1900's. Synthetic dyes have now virtually replaced natural or vegetable dyes in the textile industry, relegating natural dyes to use by hobbyists and cottage industries. The annual global sales of synthetic dyes are now estimated to be about $20,000,000,000.

Production and use of synthetic dyes produces serious toxic waste problems. The dye industry has recently attempted to reduce toxic effluents by recharging dye baths, using different dye techniques that are more efficient, recycling and recovering waste, and using computer technology to control the introduction of dyes and chemicals in the bath. Exhaustion rates have been improved in certain facilities to above about 65%; however, the average exhaustion rate remains about 40% and the synthetic dye industry continues to be a major source of pollution, discharging heavy metal salts and other toxic wastes into the environment.

Although the manufacture and use of synthetic dyes remains a major source of pollution, the commercial textile industry has rejected natural or vegetable dyes because such dyes are not reproducible and the dyed fabrics are not lightfast and washfast using present methods. Protein fibers, such as wool, are somewhat easier to dye than cellulosic fibers, and natural dyes are used commercially to a limited extent to dye protein fibers. Cotton is the primary natural fiber used by the garment industry, accounting for nearly fifty percent of the fibers used. Prior to applicant's work, however, there has been no non-toxic natural dye mordant process for dyeing cotton fibers, fabric or garments which results in a washfast and lightfast garment.

Natural dyes, such as indigo and madder, have been used since the beginning of recorded history; however, it is almost impossible using known techniques to obtain the same dye shade twice in succession with natural dyes, even using the same method. As noted by a major synthetic dye manufacturer, the color-giving molecules in the plants used for dyeing have not been "specifically designed by nature" for transfer to a substrate. Using prior natural dyeing processes, it is often necessary to choose conditions which severely damage the fiber to obtain a suitably dyed fabric. Further, it has not been possible to obtain dyed fabrics which are colorfast after washing and exposure to light, and it has not been possible to obtain a full palette of colors using natural dyes. Thus, the textile industry has generally rejected natural dyes for commercial applications.

The most commonly used mordants for natural dyes are potential sources of toxic waste. Mordants are chemicals that are necessary to chemically fix most natural dyestuffs. The mordant combines with both the dye molecule and the fiber molecule, producing a fixed insoluble "color lake." The insoluble mordant-dye complex that is chemically combined with the fiber in a mordant-dyed fiber is referred to as a color lake. Color lakes are produced with adjective dyes (dyes that require mordant). Color lakes produced by reacting a dye with a metallic salt, such as madder (alizarin) with alum, were also used in inks and paints.

The most commonly used mordants for natural dyes are alum (potassium aluminum sulfate), chrome (potassium dichromate or potassium bichromate), blue vitriol (copper sulfate), ferrous sulfate, stannous chloride, sodium dithionite or sodium hydrosulfite, ammonium hydroxide, cream of tartar (potassium bitartrate), "Glauber's salt" (sodium sulfate), lime, lye (sodium hydroxide), oxalic acid, tannic acid, urea, vinegar (acetic acid) and washing soda (sodium carbonate, also known as soda ash). As will be understood by those skilled in the art, several of these mordants produce toxic waste, but the prior art has failed to produce permanently dyed cellulose fibers or fabric which are lightfast and washfast and which produce a wide range or palette of colors, even using heavy metal salt mordants.

Among the natural dyes long known to man are indigo, madder, cochineal, cutch and osage. The mordants used with natural dyes include chromium, aluminum, iron, copper, tin and other heavy metal and polluting salts. Madder is a vegetable dye produced from species of Rubia, herbaceous perennials grown in Europe and Asia. Preparations of dyes from madder root were used to produce red, yellow and brown colorations prior to the introduction of synthetic dyes. Cochineal is an insect dyestuff indigenous to Mexico which was in use by natives when the Spaniards invaded Mexico in 1518. The insect cochineal is the *Coccus cacti* which is cultivated in Mexico and Peru for producing carmine red. Stannous chloride was the principal mordant used with cochineal. Cutch or Catechu, also known as *Terra japonica*, is obtained from various species of mimosa, acacia and areca trees chiefly found in India, Southern Asia and Africa. The commercial dye product is an extract obtained by boiling the wood, trees, leaves and fruit and processing to produce a yellow or olive color, depending upon the mordant used. Osage is a yellow dye from the wood of the Bodark tree. Indigo is a blue dye from the leaves of the indigo plant. Traditionally, no mordants have been used with indigo dyes.

The methods of processing and preparing dye liquors from madder, cochineal, cutch, osage, indigo and other natural dye substances are well-documented in the literature.

Package dyeing presents specific problems with respect to mordanting. The majority of the cotton yarns and finer wool yarns are dyed under pressure in what is known as package dye machinery. The yarn is machine wound onto a perforated dye tube. The resulting mass of yarn is known as a package. In production, many of these packages are stacked onto center cores and placed into a pressurized vessel. The mordant or dye is forced through the cores, from the inside of the package to the outside of the package. Then the flow is reversed and the mordant or dye moves from the outside to the inside. Package dyed yarns are used to produce both woven and knitted products. The dyed yarn can be easily wound onto cones that the industry uses to set up both weaving and knitting equipment. Yarns can also be beam dyed. Beam dyeing is done in the same manner as package dyeing. A beam is simply a gigantic package. A problem with the use of package dye machines for mordanting is that the wound yarn on the package may act as a filter so that much of the mordant is trapped on the outer portions of the package and relatively little penetrates into the interior, thus causing uneven dye uptake.

There is an urgent need for a natural dye process and mordant composition which can meet the needs of the commercial textile industry, including a full palette of consistently reproducible natural colors which are lightfast and washfast. Further, there is an urgent need for a mordant which does not produce toxic wastes. The mordant compositions of this invention meet both of these urgent needs.

SUMMARY OF THE INVENTION

This invention provides dry mordant compositions comprising a carbonate selected from the group consisting of soda ash (sodium carbonate) and potassium carbonate, an aluminum sulfate salt, and citric acid. The molar ratio of aluminum sulfate salt to carbonate is preferably at least about 0.7:1 (about 2.3:1 weight ratio of $Al_2(SO_4)_3$ to soda ash). The molar ratio of citric acid to soda ash is about 0.2:1 (about 0.4 weight ratio). A preferred formula for the dry mordant composition of this invention comprises about 25 g $Na_2CO_3$, about 58 g $Al_2(SO_4)_3$ and about 10 g citric acid. Variations of plus or minus about 5 weight percent are included within this preferred formula. This composition forms a suspension comprising aluminum hydroxide having a pH between about 3.5 and 4 when added to 325 ml of water.

A preferred dry mordant composition of this invention comprises about 26.8 weight percent soda ash, about 62.3 weight percent $Al_2(SO_4)_3$ and about 10.75 weight percent citric acid.

As will be understood in the art, other aluminum sulfate salts, such as alum, may be used. The ratio of aluminum sulfate salt to carbonate may be increased such as up to a molar ratio of aluminum sulfate salt to carbonate of about 2.8:1 (weight ratio of alum to soda ash of about 7:1); however, the formula is optimized at a molar ratio of about 0.7:1.

A liquid mordant composition of this invention results from adding the dry mordant composition described above to an aqueous medium to form a colloidal suspension comprising aluminum hydroxide having a pH between about 3.5 and 4 and preferably being visually clear. The amount of aqueous medium used should be enough to keep all the components in suspension; although greater amounts of aqueous medium may be used. The term "colloidal suspension" as used herein refers to the fact that no precipitation out of the aqueous medium occurs for at least a day or two. The suspension may be clear, exhibiting a Tyndall's cone effect typical of colloidal suspensions, or may be somewhat cloudy after being added to the dye machine or if the composition is extremely concentrated.

The improved mordant compositions of this invention are useful in processes for treating fibers to allow improved dye uptake when the fibers are contacted with dyes. The compositions may be used to pre-condition the fibers for dyeing, or to condition fibers during dyeing so as to lead to improved and controlled acceptance by the fibers of the dye colors, and improved colorfastness when exposed to repeated laundering and sunlight.

Fibers suitable for use with this invention include, for example, cotton, linen and hemp fibers and fabrics and synthetic textiles which are often difficult to dye including nylon, Rayon™, and Tensel™. The improved nonpolluting mordant compositions of this invention are particularly, but not exclusively, suitable for dyeing natural cellulose fibers, including cotton and linen. Such fibers also include wood and other cellulosic materials. The mordant compositions of this invention are nonpolluting.

Aluminum hydroxide from the colloidal suspension penetrates into the fibers; however, this is distinguished from precipitation of the mordant composition onto the surface of the fibers.

A basic mordant composition described in Applicant's prior application Ser. No. 08/414,341 and U.S. Pat. No. 5,403,362 is formed by adding an aluminum sulfate salt, preferably potassium aluminum sulfate ($KAl(SO_4)_2.H_2O$), also known as alum, to a solution of sodium carbonate or potassium carbonate, preferably sodium carbonate, also known as soda ash, at a ratio of aluminum sulfate salt to carbonate of about 7:1 by weight. The optimal pH for this suspension is about 3.5 to about 4.5.

This basic mordant is excellent for most dye processes, but when used in package dye machines, for example in an indigo dye process as described in Applicant's copending application for U.S. patent, Ser. No. 08/472,251 filed concurrently herewith and incorporated herein by reference, the yarn wound onto a perforated tube to form the "package" tends to act as a filter, such that aluminum hydroxide is deposited on the outer layers of the package and does not reach the inner layers.

The improved mordant composition of this invention comprising citric acid does not leave a deposit on yarn packages and penetrates evenly into the interior of the package.

In use, the dry mordant formula of this invention is mixed with water, preferably about 325 ml of water for the preferred formula, to form a colloidal suspension comprising aluminum hydroxide. More or less water can be used if desired. When the dry ingredients are blended together, the necessity for adding the carbonate to the water first as is preferred when citric acid is not part of the formula may be avoided. The blended dry ingredients of this invention may be added directly to the water. The mordant suspension has a pH between about 3.5 and 4.

To determine the maximum amount of aluminum salt which may be used, an amount of aluminum salt up to the amount which will not precipitate out from suspension may be prepared by adding the aluminum salt to a solution of the carbonate in water. Such suspensions may be initially cloudy but will gradually clear when citric acid is added. It is preferred that an amount of citric acid sufficient to bring the pH to between about 3.5 and 4.0 be used even though the suspension will be clear before this amount of citric acid has been added. At the said pH, dye uptake is optimized. The amounts of ingredients determined by this method may be provided in a dry mixture which will form the desired suspension when added to water.

When the liquid mordant composition is added to an aqueous medium containing the fibers to be dyed, the concentration of aluminum in the suspension may be from as high as is possible to achieve without causing precipitation of the aluminum hydroxide, to very low concentrations. For example, the above-described preferred mordant composition may be used undiluted to pretreat fibers, or may be diluted manyfold to form a composition having an Al concentration of about 0.003% by weight of Al to weight of water without loss of usefulness. The fibers take up the aluminum hydroxide even from very dilute solutions such that the amount of aluminum per gram of fiber is more important than the concentration of the mordant composition.

A further mordant composition of this invention comprises a colloidal suspension of aluminum hydroxide in aqueous medium formed by adding about 15% weight of fiber (wof) aluminum sulfate, about 7.5% wof sodium or potassium carbonate, and about 0.4 wof citric acid to an aqueous medium. Another preferred mordant composition of this invention used as a second mordant treatment is formed using about 3% wof aluminum sulfate, about 1.5% wof soda ash and about 0.6% wof citric acid. A third preferred mordant composition for use as a second mordant treatment is formed using about 3.75% to about 5% wof aluminum sulfate, about 1.9% to about 2.5% wof sodium or potassium carbonate, and about 0.10% to about 0.13% wof citric acid. The amount of the second mordant composition depends on the type of fabric being treated. Less mordant is required for loosely structured materials such as knits and yarns with loose structures than for tightly woven materials and dense yarns. Unless otherwise specified, all weight percentages referred to herein are wof.

As is known to those skilled in the art, the amount of water used for dyeing is based on the weight of fibers, and the weight ratio of water to fibers to be dyed is called the liquor ratio. In general, liquor ratios in the art are about 10:1 to about 20:1 preferably about 15:1. Liquor ratios used in the art used for dyeing are suitable for use with this invention. The Al concentration varies from the maximum concentration which can be maintained in suspension in the colloidal suspension in which the fibers are treated to the least concentration which will be effective in mordanting.

The dry components may be added simultaneously to the aqueous medium, or the aluminum sulfate salt may be added slowly, with agitation, to a solution containing the carbonate followed by addition of the citric acid. The components are mixed at a temperature high enough to keep the components in suspension, preferably between about 90° F. and up to, but preferably not including, boiling temperature. Preferably the temperature at which the mordant composition is formed is between about 120° and about 180° F.

The colloidal suspension is added to an aqueous medium in which fibers are to be treated. The aqueous medium may be water, or may contain other substances, i.e. dyes, preferably natural dyes such as indigo, madder, cutch, cochineal and osage orange, as well as other dyes known to the art. The dye is present at a concentration required to achieve the desired color, as is known to the art.

The aqueous medium may also comprise a weak solution of tannin for further setting the dye in the fibers. Preferably, tannin is present at a concentration between about 0.5% wof and about 5% wof, more preferably about 1% wof to about 3% wof.

Aqueous media in which the fibers are treated, having a liquor ratio of about 10:1 to about 20:1 also comprise compositions of this invention. Such compositions, as claimed herein, may or may not contain the fibers to be treated. Although the dry ingredients of this invention may be added directly to the aqueous medium in which the fibers are to be treated, e.g., in the chamber of the dyeing machine, it is preferred that they be premixed to form a concentrated suspension as described above before being added to the aqueous medium for the fibers, as this enhances the colorfastness of the dyed material.

The improved mordant compositions of this invention produce permanently dyed fibers and fabrics or textiles which are colorfast when exposed to light and washing, and can be used to produce a full palette of reproducible natural colors. Further, the mordant compositions of this invention do not require the use of heavy metal salts or iron and thus produce permanently dyed fibers in a wide range of colors without producing toxic waste. The mordant compositions of this invention allow use of significantly less energy than heretofore used in commercial dye processes. This invention thus solves the problems associated with prior natural dye processes and avoids the pollution and toxic waste problems associated with synthetic dyes.

This invention also provides a process for conditioning fibers for dyeing comprising: contacting the fibers with a mordant comprising an aqueous colloidal suspension comprising aluminum hydroxide having a pH about 3.5 to about 4, formed by adding a carbonate selected from the group consisting of sodium carbonate, potassium carbonate and mixtures thereof, an aluminum sulfate salt, and citric acid to warm water to form a suspension having a pH between about 3.5 and 4, and adding said suspension to an aqueous medium for treating the fibers (in which aqueous medium the fibers may be present or may be added), wherein the mordant is present in amount sufficient to fix a dye for a time sufficient to cause uptake by the fibers of said mordant.

The term warm water means water at a temperature above about 90° F. Preferably, the temperature is between about 100° F. and 180° F.; and more preferably between about 110° F. and about 140° F.

The fibers to be dyed may include cellulose fibers and synthetic fibers, preferably cellulose fibers.

The dye to be used is preferably natural dye, but may also be synthetic dye such as synthetic indigo.

The amount of time required for uptake of sufficient mordant to fix dye on the fibers is preferably about 10 minutes to about one hour. The term "fix a dye" means to improve the washfastness and lightfastness of the dyed fibers over that of fibers similarly dyed without a mordant.

The amount of mordant to be used is readily ascertainable by one skilled in the art and depends on the fabric or yarn structure (loose or tight) and the depth of shade desired. In general, a composition comprising the dry mordant of this invention in an aqueous medium at a concentration of about 28.6 wt percent diluted to provide a liquor ratio (water to fiber by weight) of about 10:1 to about 20:1 will be useful.

A process is also provided for dyeing fibers comprising: (1) pretreating the fibers with a mordant comprising an aqueous colloidal suspension of aluminum hydroxide having a pH about 3.5 to about 4, formed by adding a carbonate selected from the group consisting of sodium carbonate, potassium carbonate and mixtures thereof, an aluminum sulfate salt and citric acid to warm water, by mixing said suspension with an aqueous medium in which fibers to be treated are present, or are subsequently added, wherein the mordant is present in amount sufficient to fix a dye; and (2) treating the fibers with an aqueous solution containing a dye liquor wherein the dye is present in an amount sufficient to dye the fibers.

The fibers will be substantially permanently dyed, i.e., will meet industry standards for lightfastness and washfastness. The amount of dye to be used is readily ascertainable by those skilled in the art depending on the fiber to be dyed and the color desired.

A second mordanting with a more dilute mordant composition of this invention and treatment with tannin may also be desirable.

A further process for treating yarn with a mordant is also provided comprising: (a) inserting yarn wound onto a perforated tube into a first enclosed container of a package dye machine; (b) adding to the first container of the package dye machine or to a second container connected by liquid conduits to the first container, a liquid mordant composition formed by adding an aluminum sulfate salt, a carbonate selected from the group consisting of sodium carbonate, potassium carbonate and mixtures thereof, and citric acid to water to form a colloidal suspension comprising aluminum hydroxide and having a pH between about 3.5 to 4, in an amount sufficient to provide improved dye uptake by said yarn; and (c) causing the aqueous medium in the container to which the mordant composition has been added to be circulated through the yarn whereby the yarn takes up the mordant in amounts sufficient to fix dye thereon.

DETAILED DESCRIPTION OF THE PREFERRED EMBODIMENTS

A preferred first mordant colloidal suspension of this invention is formed by adding aluminum sulfate $(Al_2SO_4)_3$, soda ash and citric acid to water or other aqueous medium to form a suspension comprising aluminum hydroxide and having a pH between about 3.5 and 4. This suspension is then added to an aqueous medium containing fibers to be premordanted before dyeing, preferably cotton or linen garments, at a molar ratio of aluminum sulfate to soda ash of about 0.7:1 and a molar ratio of citric acid to soda ash of about 0.2:1. The mordant compositions of this invention may be used to pretreat (premordant) fibers to be dyed with synthetic or natural dyes, preferably indigo, cutch, madder, cochineal, osage orange, other natural dyes and combinations of natural dyes. The use of the mordant compositions of this invention with indigo is described in U.S. Pat. No. 5,378,246, U.S. patent application Ser. No. 08/355,241 filed Dec. 23, 1994, and U.S. patent application Ser. No. 08/472,251 filed concurrently herewith, all incorporated herein by reference.

The amount of aluminum salt, carbonate and citric acid used are optimized depending primarily on the fiber used. More of the mordant composition is used with tightly woven or heavy fibers, and less concentrated suspensions are used with lighter knitted fabrics. The amount of mordant composition is also optimized depending on the shade desired to be achieved by the dye process. As is usual in the art of dyeing, amounts of mordant composition are adjusted as required.

In general in the dyeing art, when a deeper shade is desired, the dye process takes longer than when a light shade is desired; however, the mordant compositions of this invention allow dyeing to achieve dark shades in the same amount of time as to achieve light shades.

The fibers to be dyed, which may be in the form of garments, pieces of textile, or yarn, preferably garments, are preferably wetted out by agitating with a commercial wetting solution, e.g., "Ecowet"™, available from Southwest Chemical Corporation. Next the liquid mordant composition of this invention is added, preferably at a temperature of about 110° F. to about 120° F., and the fibers are agitated in the mordant composition and heated to about 180° F. to about 185° F. The fibers are then agitated in the mordant composition at the 180° F. to 185° F. temperature for about 15 to 20 minutes until the aluminum hydroxide is substantially exhausted onto the fibers. The dye machine may then be drained, the fibers rinsed in warm water and optionally dried. The fibers are then ready for dyeing. Alternatively, the dye may be added to the aqueous medium already in the chamber of the machine.

The fibers may be wetted out again; then they are agitated in an aqueous solution of the natural dye liquor for a time sufficient to reach the desired temperature and for uptake of the dye. Generally, the aqueous medium in the dye machine will become noticeably clearer as the dye is exhausted onto the fibers. Suitable dye temperatures are known to the art. The dye bath is agitated at the appropriate temperature for about fifteen minutes.

A second mordant composition of this invention is then introduced, preferably a mordant composition of this invention utilizing one-fourth to one-third the concentration of dry ingredients as the first mordant composition used to pretreat the fibers. The second mordant composition aids in fixing the dye, resulting in improved colorfastness. The amount used is generally dependent on the depth of shade desired, darker shades generally requiring a higher concentration or greater volume of the mordant suspension. Excess mordant can be added, i.e., up to half again as much as the minimum required to optimally set the dye, without adversely affecting the dye quality. The second mordant composition is preferably introduced near the end of the dye cycle and the fibers are agitated in the mordant and dye solution for about fifteen minutes at a temperature less than boiling and preferably about 180° F. to 185° F. Finally, the fibers are preferably agitated in a weak aqueous solution of tannic acid or tannin, which may be added to the dye bath containing the second mordant, or the dye bath containing the second mordant may be drained and the tannin treatment done in a separate step.

In an alternative process found to be useful for dyeing fibers (preferably with osage), the concentrated liquid mordant composition of this invention may be added directly to the dye bath rather than being used for premordanting. When the mordant composition is added to the dye bath, the dye bath should optimally be at a temperature of at least about 150° F. and not more than about 170° F. Then the temperature is raised to about 180° F. to about 185° F. and the machine is agitated for about fifteen minutes. After the dye has exhausted onto the fibers, tannin can be added, without draining the dye machine, and agitation continued for about fifteen minutes.

In general, best results are achieved by premordanting the fibers prior to dyeing, whether garment dyeing, piece dyeing, range dyeing, or package dyeing. In the case of indigo, the fibers should be premordanted if it is desired to use a mordant.

Natural dye processes using mordant compositions of this invention may be carried out in a conventional commercial or industrial washing machines, or garment, piece dyeing, package dyeing or range dyeing machines. For garment dyeing, a computer-controlled industrial washing machine adapted for garment dyeing may be used, as it allows the operator to preprogram the introduction of fluids such as water into the washing machine chamber or basket, temperature and time, including wash and agitation cycles, etc. Further, it is possible to program an industrial washer to raise or lower the temperature while agitating the fibers as described herein. A suitable industrial washing machine for the dyeing processes using the mordant compositions of this invention is the Unimac Washer Extractor made by Unimac Corporation. The natural dye processes using mordant compositions of this invention, may, however, be adapted to existing professional garment dye machines.

Commercial package dye machines comprise a package kier and an expansion tank (also referred to as a holding tank). A modified package dye machine useful for dyeing indigo is described in applicant's copending application Ser.

No. 08/472,251 filed concurrently herewith and incorporated herein by reference. The package kier is a container designed to hold at least one perforated dye tube set on a spindle inside the package kier. The dye tube is perforated at spaced intervals to allow liquid to be forced through the yarn and through the tube under pressure from the outside in and from the inside out. The bottom of the package kier is connected to the bottom of the holding tank by a conduit equipped with a reversing pump so that liquid containing mordant or dye can be pumped under pressure from the holding tank and through the yarn in the package kier. A further conduit connecting the top portions of the package kier and holding tank allows circulation of the liquid between the two containers.

In the process of this invention, the mordant composition of this invention is premixed to form a concentrated suspension comprising aluminum hydroxide having a pH of about 3.5 to 4, and added to the holding tank of a package dyeing machine which may be a conventional package dyeing machine or one which has been modified for use with indigo as described in applicant's above-referenced application filed concurrently herewith. A liquor ratio of about 10:1 to about 20:1 may be used depending on the type of yarn as is known to the art. The preferred temperature is about 100° F. to about 180° F. The mordant composition is allowed to circulate through the machine, being forced through the yarn for a period of about 10 minutes to about an hour to allow for optimal uptake by the yarn. The mordant solution may then be replaced by dye liquor in the package dyeing machine for dyeing of the yarn. The mordant composition of this invention is deposited evenly throughout the entire package.

The mordant dye process of this invention does produce consistent dyed textile pieces and garments in a wide range of natural colors. Further, the colors are washfast and lightfast. The American Association of Textile Colorists and Chemists has developed standardized tests to determine whether a dyed fabric is washfast (Test No. 61A) and lightfast (Test No. 16E). The potential score or index on such tests ranges from 0 to 5. The natural dye mordant process of this invention results in a dyed fabric which scores between 3 and 5 on such tests, equal to or greater than synthetic dyes on the same fabrics.

As will be understood by those skilled in the art, certain modifications can be made to the mordant compositions and natural dye processes using the mordant compositions of this invention within the purview of the appended claims. The dry mordant compositions and colloidal suspensions of aluminum hydroxide of this invention are not limited to use with the natural dyes mentioned herein, but effective compositions may be prepared using these mordant compositions in combination with other dyes. Further, other fibers than cellulose fibers may be dyed using these compositions. The compositions of this invention may be used with some synthetic yarns and fabrics. The compositions of this invention comprising mordant colloidal suspensions and dyes and/or tannin are all useful to produce improved dyed fibers or fabric. For example, the use of a final tannin treatment following the dye-mordant step resulted in a 10 to 20% improvement in washfastness and lightfastness. The use of an aqueous colloidal suspension comprising aluminum hydroxide resulted in a 20 to 40% improvement in washfastness and lightfastness tests, and the use of a second mordant treatment resulted in a further 10% improvement. As will be understood by those skilled in the art, these improvements were unexpected, particularly in view of the long history of the use of natural dyes and the replacement of natural dyes by synthetic dyes over a century ago.

EXAMPLES

Example 1

Preparation of Mordant Composition.

A mordant composition for pretreating about 9,100 g (about 20 lb) of cotton jersey garments was prepared. A composition comprising 6.8% weight of the fibers (620 g) of soda ash, 15.6% Wof (1420 g) $Al_2(SO_4)_3$, and 2.7% wof (250 g) citric acid was added to eight liters of warm water and stirred. The solution was then heated to about 150° F. and stirred, forming a colloidal suspension comprising aluminum hydroxide in water.

Example 2

Pretreating of Fibers.

The garments of Example 1 are pretreated with the mordant composition of Example 1 as follows. The garments are first wetted out with warm water and 40 ml of "Ecowet" commercial wetting solution. The liquid mordant composition of this invention having a pH between about 3.5 and 4 is then added and the garments agitated in the mordant composition for an additional ten minutes. The aqueous mordant composition is then heated to 185° F and agitated for about 20 more minutes. The garments and mordant composition are then cooled to 120°–140° F., drained and rinsed.

Example 3

Cochineal Dyeing.

Cotton jersey fibers in the form of garments are dyed with cochineal as follows: Twenty pounds (9,100 g) of cotton jersey fibers in the form of garments premordanted as in Example 2 are wetted out with warm water containing 40 ml of "Ecowet solution. One gallon (2.79 liters) of water between 95°–120° F. containing cochineal dye extract is added to the wetted out fibers and heated at four degrees per minute to 190° F. The fibers are then agitated in the aqueous dye solution for 20–40 minutes. A second aqueous mordant composition containing 1.68% weight of fibers (153.7 g) soda ash, 3.9% weight of fibers (356 g) aluminum sulfate, and 0.68% weight of fibers citric acid (61.5 g) is added and the fibers are agitated for fifteen minutes. The second mordant composition forms a colloidal suspension comprising aluminum hydroxide. The mordant composition runs at temperature for 15 minutes. After 15 minutes, an aqueous solution containing 1% weight of fibers (91 g) tannin is added to the chamber. The temperature need not be maintained, but preferably the machine is allowed to run for about 15 minutes. The machine is then drained, the fibers are washed with detergent, rinsed and dried. Liquor ratios of 15:1 are used for all steps.

Example 4

Osage Dyeing.

Twenty pounds of cotton garments are placed in the chamber of a commercial garment dye machine, water is added to the machine at a liquor ratio of 15:1. Osage dye solution prepared from raw osage wood using 15% osage wood wof is added to the machine. Four hundred ml/lb of fiber of a liquid mordant composition of this invention is added after about ten minutes at about 110° F. The mordant composition comprises 1.68% wof aluminum sulfate, 3.9% wof soda ash, and 0.68% wof citric acid. The temperature is raised to 180° F. and the dye bath kept at that temperature for 15 to 20 minutes as the chamber is agitated. Tannin is added at 1.5% wof. The chamber is then drained and the fibers washed.

I claim:

1. A blended dry composition useful as a mordant for dyeing fibers consisting essentially of the following components: an aluminum salt, citric acid, and a carbonate selected from the group consisting of sodium carbonate, potassium carbonate, and mixtures thereof, wherein said dry composition forms a colloidal suspension of all said components comprising aluminum hydroxide and having a pH between about 3.5 and 4 when added to water to provide a 28.6 weight percent concentration.

2. The composition of claim 1 wherein said aluminum salt is $Al_2(SO_4)_3$.

3. The composition of claim 1 wherein said aluminum salt is alum.

4. The composition of claim 1 wherein said carbonate is sodium carbonate.

5. The composition of claim 1 wherein said carbonate is potassium carbonate.

6. The composition of claim 1 wherein said aluminum salt is $Al_2(SO_4)_3$ and said carbonate is sodium carbonate.

7. The composition of claim 1 comprising about 26.8 weight percent soda ash, about 62.3 weight percent $Al_2(SO_4)_3$ and about 10.75 weight percent citric acid.

8. A composition comprising a mordant for dyeing fibers which comprises a colloidal suspension of aluminum hydroxide in aqueous medium formed by adding the dry composition of claim 1 to water, and further comprising a dye.

9. The composition of claim 8 wherein said dye is selected from the group consisting of madder, cutch, cochineal, and osage.

10. The composition of claim 9 also comprising tannin.

11. The blended dry composition of claim 1 which forms a visually clear colloidal suspension when added to water.

12. A process for treating fibers with a mordant comprising pretreating said fibers with a mordant comprising an aqueous colloidal suspension having a pH of about 3.5 to about 4, formed by adding an aluminum sulfate salt, citric acid, and a carbonate selected from the group consisting of sodium carbonate, potassium carbonate and mixtures thereof, to warm water wherein the mordant is present in an amount sufficient to fix a dye.

13. A process for dyeing fibers comprising the following steps:

(a) pretreating said fibers with a mordant comprising aqueous colloidal suspension having a pH of about 3.5 to about 4, formed by adding an aluminum sulfate salt, citric acid, and a carbonate selected from the group consisting of sodium carbonate, potassium carbonate, and mixtures thereof, to warm water, wherein the mordant is present in an amount sufficient to fix a dye; and (b) treating said fibers with an aqueous solution containing a dye wherein the dye is present in an amount sufficient to dye said fibers.

14. The process of claim 13 wherein said aluminum sulfate salt is present at a molar ratio to said carbonate of about 0.7 to 1.

15. The process for dyeing fibers as defined in claim 13, wherein said process further includes treating said fibers with said mordant following dyeing.

16. The process for dyeing fibers as defined in claim 15 wherein said process further includes treating said fibers with an aqueous solution of tannic acid following treating said fibers with said mordant following dyeing.

17. The process for dyeing fibers as defined in claim 13 wherein said mordant is formed by adding said aluminum sulfate salt, carbonate and citric acid as dry ingredients to an aqueous medium, and agitating and heating said solution to a temperature of at least about 90° F.

18. A process for treating yarn with a mordant comprising:

(a) inserting said yarn wound onto a perforated tube into a first enclosed container of a package dye machine;

(b) adding to said first container of said package dye machine or a second container connected by liquid conduits to said first container, a mordant composition comprising an aluminum sulfate salt, citric acid in amounts sufficient to produce a pH in said container to which said mordant composition is added of about 3.5 to 4 in an aqueous medium therein, and a carbonate selected from the group consisting of sodium carbonate, potassium carbonate and mixtures thereof; and (c) causing said aqueous medium in said container to which said mordant composition has been added to be circulated through said yarn whereby said yarn takes up said mordant in amounts sufficient to fix dye thereon.

19. The process of claim 18 wherein said mordant composition comprises $Al_2(SO_4)_3$, $Na_2CO_3$ and citric acid wherein said $Al_2(SO_4)_3$ is present at a weight ratio to said $Na_2CO_3$ of about 2.3:1.

20. The process of claim 18 wherein said mordant composition is circulated through said yarn for between about 10 minutes and about one hour.

* * * * *